US005341883A

United States Patent [19]

Ringgenberg

[11] Patent Number: 5,341,883

[45] Date of Patent: Aug. 30, 1994

[54] PRESSURE TEST AND BYPASS VALVE WITH RUPTURE DISC

[75] Inventor: Paul D. Ringgenberg, Carrollton, Tex.

[73] Assignee: Halliburton Company, Houston, Tex.

[21] Appl. No.: 4,337

[22] Filed: Jan. 14, 1993

[51] Int. Cl.[5] ..... E21B 34/10

[52] U.S. Cl. ..... 166/324; 166/334

[58] Field of Search ..... 166/323, 324, 264, 374, 166/386, 387, 334

[56] References Cited

U.S. PATENT DOCUMENTS

| | | | |
|---|---|---|---|
| 2,742,093 | 4/1956 | Vaughn | 166/224 |
| 3,329,007 | 7/1967 | Conrad | 73/40.5 |
| 3,332,495 | 7/1967 | Young | 166/148 |
| 3,354,950 | 11/1967 | Hyde | 166/336 |
| 3,470,903 | 10/1969 | Scott | 137/467 |
| 3,779,263 | 12/1973 | Edwards et al. | 137/68 |
| 3,850,250 | 11/1974 | Holden | 166/374 |
| 3,970,147 | 7/1976 | Jessup et al. | 166/323 X |
| 4,100,969 | 7/1978 | Randermann, Jr. | 166/324 |
| 4,105,075 | 8/1978 | Helmus | 166/321 |
| 4,113,012 | 9/1978 | Evans | 166/264 |
| 4,122,898 | 10/1978 | Nelson | 166/325 |
| 4,125,165 | 11/1978 | Helmus | 166/323 |
| 4,161,985 | 7/1979 | Fournier et al. | 166/321 |
| 4,295,361 | 10/1981 | McMahan | 73/40.5 R |
| 4,319,633 | 3/1982 | McMahan et al. | 166/250 |
| 4,319,634 | 3/1982 | McMahan et al. | 166/250 |
| 4,421,172 | 12/1983 | McMahan | 166/334 |
| 4,458,762 | 7/1984 | McMahan | 166/373 |
| 4,560,004 | 12/1985 | Winslow et al. | 166/321 |
| 4,603,740 | 8/1986 | Edwards et al. | 166/323 X |
| 4,603,742 | 8/1986 | Wong et al. | 166/386 X |
| 4,609,005 | 9/1986 | Upchurch | 137/68.1 |
| 4,619,325 | 10/1986 | Zunkel | 166/387 X |
| 4,627,492 | 12/1986 | MacLaughlin | 166/250 |
| 4,655,288 | 4/1987 | Burris et al. | 166/319 |
| 4,665,983 | 5/1987 | Ringgenberg | 166/250 |
| 4,694,903 | 9/1987 | Ringgenberg | 166/250 |
| 4,903,775 | 2/1990 | Manke | 166/387 X |

OTHER PUBLICATIONS

Halliburton Services Flyer ST-10066 entitled "Special Tools Technical Data" (Undated but admitted to be prior art).

Baker Oil Tools, Inc. Technical Manual pages entitled "Model S Full-Bore Tubing Tester, Sizes 2-⅜ & 2-7/8, Product No. 672-05", Sep. 15, 1973.

*Primary Examiner*—Roger J. Schoeppel

*Attorney, Agent, or Firm*—Tracy W. Druce; Neal R. Kennedy

[57] ABSTRACT

A pressure test and bypass valve for use in well testing. The apparatus comprises a housing defining a central opening therein and a mandrel slidably disposed in the central opening. A ball valve allows fluid flow through the central opening when in an open position and prevents fluid flow therethrough when in a closed position. A sleeve valve allows communication between the central opening and a well annulus when in an open position and prevents communication between the central opening and the well annulus when in a closed position. The ball valve and sleeve valve are actuated substantially simultaneously in response to well annulus pressure. A rupture disc is ruptured due to differential pressure thereacross. This allows well annulus pressure to act across a differential area on the mandrel such that the mandrel is moved relative to the housing, thereby actuating the valves.

20 Claims, 3 Drawing Sheets

PRESSURE TEST AND BYPASS VALVE WITH RUPTURE DISC

BACKGROUND OF THE INVENTION

1. Field of the Invention

This invention relates to pressure test and bypass valves used in well testing, and more particularly, to a combination pressure test and bypass valve which is pressure actuated in response to rupturing of a rupture disc.

2. Description of the Prior Art

Numerous well service operations entail running a packer into a well bore at the end of a string of tubing or drill pipe, and setting the packer to isolate a production formation or "zone" intersected by the well bore from the well bore annulus above the packer. After this isolation procedure, a substance such as a cement slurry, an acid or other fluid is pumped through the tubing or drill pipe under pressure and into the formation behind the well bore casing through perforations therethrough in an area below the packer. One major factor in insuring the success of such an operation is to have a pressure-tight string of tubing or drill pipe.

Another common well service operation in which it is desirable to assure the pressure integrity of the string of tubing or drill pipe is the so-called drill stem test. Briefly, in such a test, a testing string is lowered into the well to test the production capabilities of the hydrocarbon producing underground formations or zones intersected by the well bore. The testing is accomplished by lowering a string of pipe, generally drill pipe, into the well with a packer attached to the string at its lower end. Once the test string is lowered to the desired final position, the packer is set to seal off the annulus between the test string and the well casing, and the underground formation is allowed to produce oil or gas through the test string. As with the previously mentioned well service operations, it is desirable, prior to conducting a drill stem test, to be able to pressure test the string of drill pipe periodically to determine whether there is any leakage at the joints between the successive stands of pipe.

To accomplish this drill pipe pressure testing, the pipe string is filled with a fluid and the lowering of the pipe is periodically stopped. When the lowering of the pipe is stopped, the fluid in the string of drill pipe is pressurized to determine whether there are any leaks in the drill pipe above a point near the packer at the end of the string.

In the past, a number of devices have been used to test the pressure integrity of the pipe string. In some instances, a closed formation tester valve included in the string is used as the valve against which pressure thereabove in the testing string is applied. In other instances, a so-called tubing tester valve is employed in the string near the packer, and pressure is applied against the valve element in the tubing tester valve.

A problem with prior art pressure test/bypass valves is that the valve element therein may be operated prematurely when pulling out of the production packer. The present invention solves this problem by providing a tool which can be stung into and out of the production packer as many times as desired without prematurely opening the valve.

SUMMARY OF THE INVENTION

The pressure test and bypass valve of the present invention comprises a housing means for defining a central opening therein and a port therein in communication with the central opening, mandrel means for sliding in the central opening, first valve means for allowing fluid flow through the central opening when in an open position and for preventing fluid flow through the central opening when in a closed position, second valve means for allowing communication between the central opening and a well annulus when in an open position and preventing communication between the central opening and the well annulus when in a closed position, and pressure responsive means for substantially simultaneously actuating the first and second valve means between the open and closed positions thereof in response to a pressure in the well annulus. In the preferred embodiment, the first valve means is characterized by a ball valve connected to the mandrel means, and the second valve means is characterized by a valve sleeve connected to the mandrel means and defining a port therethrough in communication with the port in the housing means when the second valve means is in the open position thereof. The first valve means is preferably initially in the closed position thereof, and the second valve means is preferably initially in the open position thereof.

A cushioning means may be provided for cushioning movement of the valve sleeve with respect to the housing means after actuation thereof by the pressure responsive means.

The apparatus may further comprise means for compensating for different longitudinal movement of components of the first and second valve means after actuation thereof by the pressure responsive means.

The pressure responsive means is preferably characterized by a rupture disc which is adapted for rupturing in response to a differential pressure thereacross and thereby allowing the annulus pressure to act across an area on the mandrel means such that the mandrel means is moved relative to the housing means.

The apparatus may additionally comprise shearing means for shearably holding the mandrel means with respect to the housing means and for shearing in response to the annulus pressure being applied to the mandrel means after application of the annulus pressure to the pressure responsive means.

Numerous objects and advantages of the invention will become apparent as the following detailed description of the preferred embodiment is read in conjunction with the drawings which illustrate such embodiment.

DETAILED DESCRIPTION OF THE PREFERRED EMBODIMENT

During the course of drilling an oil well, the borehole is filled with a fluid known as drilling fluid or drilling mud. One of the purposes of this drilling fluid is to contain in intersected formations any formation fluid which may be found there. To contain these formation fluids, the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth, and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing in the formation from the hydrostatic pressure of the drilling fluid in the well annulus. The formation tester valve at the lower end of the testing string is then opened and the formation fluid, free from the restraining pressure of the drilling fluid, can flow into the interior of the testing string.

Alternatively, rather than lowering a packer concurrently with the testing string and setting the packer before actuation of the testing string, in many instances a packer has been previously set in the borehole, and the testing string merely engages the packer or "stings into it", and controls the flow of fluids therethrough during the testing program.

The well testing program includes periods of formation flow and periods when the formation is closed in. Pressure recordings are taken throughout the program for later analysis to determine the production capability of the formation.

Figure 1:
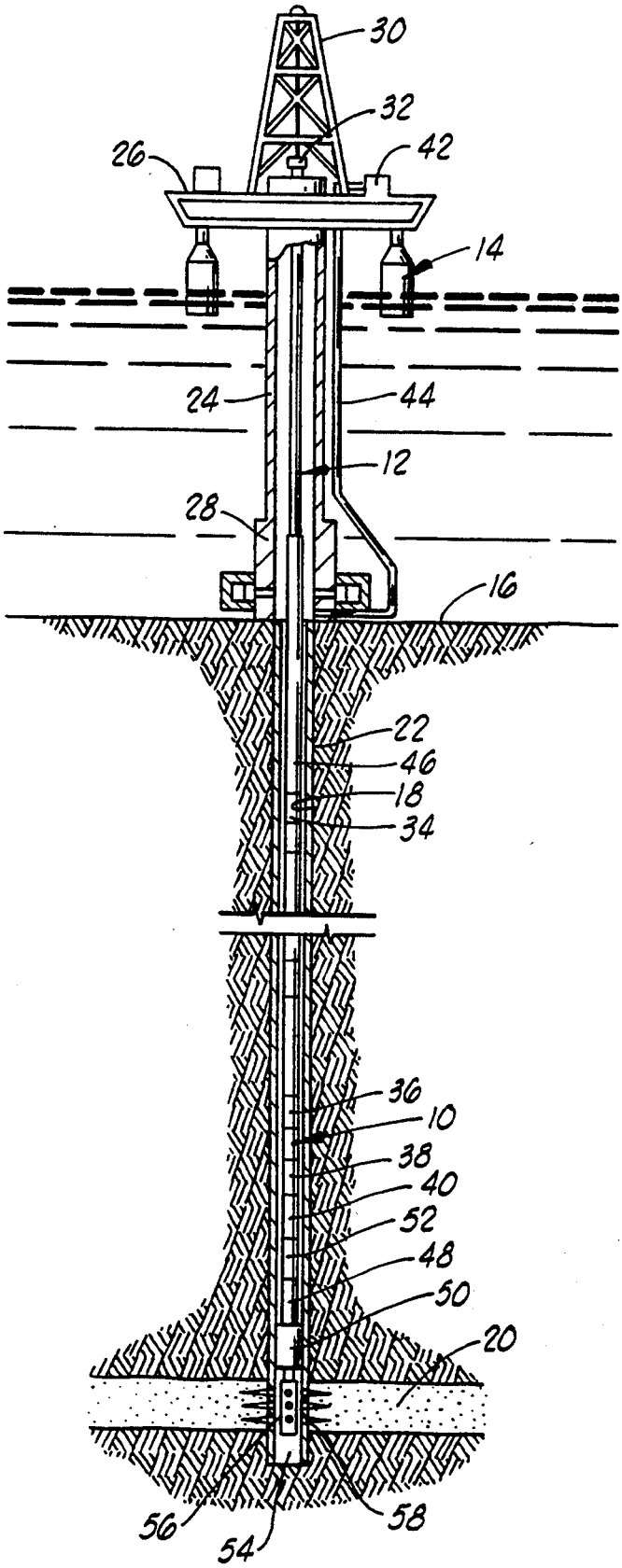
FIG. 1 shows a schematic view of a well test string, including the pressure test and bypass valve of the present invention, in place on an offshore well.

Referring now to the drawings, and more particularly to FIG. 1, the bypass test and pressure valve of the present invention is shown and generally designated by the numeral 10. Valve apparatus 10 is shown as part of a testing string 12 utilized on a floating work station 14 which is centered over a submerged oil or gas well located in the sea floor 16. The well has a well bore 18 which extends from the sea floor 16 to a submerged formation 20 to be tested. Well bore 18 is typically lined by a steel casing 22 cemented into place.

A subsea conduit 24 extends from deck 26 of floating work station 14 into a well head installation 28. Floating work station 14 has a derrick 30 and a hoisting apparatus 32 for raising and lowering tools to drill, test and complete the oil or gas well. For example, hoisting apparatus 32 is used to lower testing string 12 into well bore 18 of the well.

In addition to pressure test and bypass valve apparatus 10, tubing string 12 includes such tools as one or more pressure balanced slip joints 34 to compensate for the wave action of floating work station 14 as testing string 12 is lowered into place. Testing string 12 may also include a circulation valve 36, a formation tester valve 38 and a sampler valve 40.

Slip joint 34 may be similar to that described in U.S. Pat. No. 3,354,950 to Hyde. Circulation valve 36 is preferably of the annulus pressure responsive type such as described in U.S. Pat. Nos. 3,850,250 or 3,970,147. Circulation valve 36 may also be of the reclosable type described in U.S. Pat. No. 4,113,012 to Evans et al.

Tester valve 38 is preferably of the annulus pressure responsive type, and being further described as the type with the capability to be run into the well bore in an open position. Such valves are known in the art and are described in U.S. Pat. No. 4,655,288, assigned to the assignee of the present invention.

Sampler valve 40 is preferably of the annulus pressure responsive type having a full open bore therethrough, as described in U.S. Pat. No. 4,665,983, assigned to the assignee of the present invention.

As shown in FIG. 1, circulation valve 36, valve 10 of the present invention, formation tester valve 38, and sampler valve 40 are operated by fluid annulus pressure exerted by a pump 42 on the deck of floating work station 14. Pressure changes are transmitted by pipe 44 to well annulus 46 between casing 22 and testing string 12. Well annulus pressure is isolated from formation 20 by a packer 48 having an expandable sealing element 50 thereabout set in well casing 22 just above formation 20. Packer 48 may be a Baker Oil Tools Model D packer, Otis Engineering Corporation type W packer, Halliburton Services "EZ DRILL® SV", "RTTS" or "CHAMP®" packers or other packers well known in the well testing art.

Testing string 12 may also include a tubing seal assembly 52 at the lower end of the testing string which "stings" into or stabs through a passageway through packer 48 if such is a production packer set prior to running testing string 12 into the well bore. Tubing seal assembly 52 forms a seal with packer 48, isolating well annulus 46 above the packer from an interior bore portion 54 of the well immediately adjacent to formation 20 and below packer 48.

A perforating gun 56 may be run via wireline or may be disposed on a tubing string at the lower end of testing string 12 to form perforations 58 in casing 22, thereby allowing formation fluids to flow from formation 20 into the flow passage of testing string 12 via perforations 58. Alternatively, casing 22 may have been perforated prior to running test string 12 into well bore 18.

As previously noted, pressure test/bypass valve 10 of the present invention may be used to pressure test testing string 12 as the testing string is lowered into the well. As test depth is reached, pressure in well annulus 46 is increased by pump 42 through pipe 44, whereupon valve 10 is placed in an open position, and further described herein.

A formation test controlling the flow of fluid from formation 20 through the flow channel and testing string 12 may then be conducted by applying and releasing fluid annulus pressure to well annulus 46 by pump 42 to operate circulation valve 36, formation tester valve 38 and sampler valve 40, accompanied by measuring of the pressure buildup curves and fluid temperature curves with appropriate pressure and temperature sensors in testing string 12, all as fully described in the aforementioned patents.

It should be understood, as noted previously, that pressure test/bypass valve 10 of the present invention is not limited to use in a testing string as shown in FIG. 1, or even to use in well testing per se. For example, apparatus 10 may be employed in a drill stem test wherein no other valves, or fewer valves than are shown in FIG. 1, are employed. In fact, apparatus 10 of the present invention may be employed in a test wherein all pressure shutoffs are conducted on the surface at the rig floor, and no "formation tester" valves are used at all. Similarly, in a cementing, acidizing, fracturing or other well service operations, apparatus 10 of the present invention may be employed whenever it is necessary or desirable to assure the pressure integrity of a string or drill pipe.

Referring now to FIGS. 2A–2D, details of pressure test/bypass valve apparatus 10 of the present invention will be discussed.

Valve apparatus 10 comprises a housing means 60 for connecting to testing string 12 and defining a central opening 62 therethrough. At the upper end of housing means 60 is an upper adapter 64 with an internally threaded surface 66 for connecting to an upper portion of testing string 12.

Upper adapter 64 is attached to an upper seat carrier 68 at threaded connection 70. Upper seat carrier 68 is part of housing means 60 and has a first outside diameter 72 and a second outside diameter 74 with a radially outwardly extending shoulder portion 76 therebetween.

A sealing means, such as seal 78, provides sealing engagement between upper adapter 64 and first outside diameter 72 of upper seat carrier 68.

A first or upper valve case 80, shown as a ball valve case 80, is disposed adjacent to the lower end of upper adapter 64 such that an outside diameter 82 of upper adapter 64 fits closely within a bore 84 in ball valve case 80. Valve case 80 also forms part of housing means 60. A sealing means, such as seal 86, provides sealing engagement between upper adapter 64 and valve case 80.

A plurality of outwardly extending splines 88 on upper seat carrier 68 engage a corresponding plurality of inwardly extending splines 90 in valve case 80 so that relative rotation between the upper seat carrier and valve case 80 is prevented.

It will be seen that an annular volume 92 is defined between bore 84 of valve case 80 and second outside diameter 74 of upper seat carrier 68.

Figure 2A:
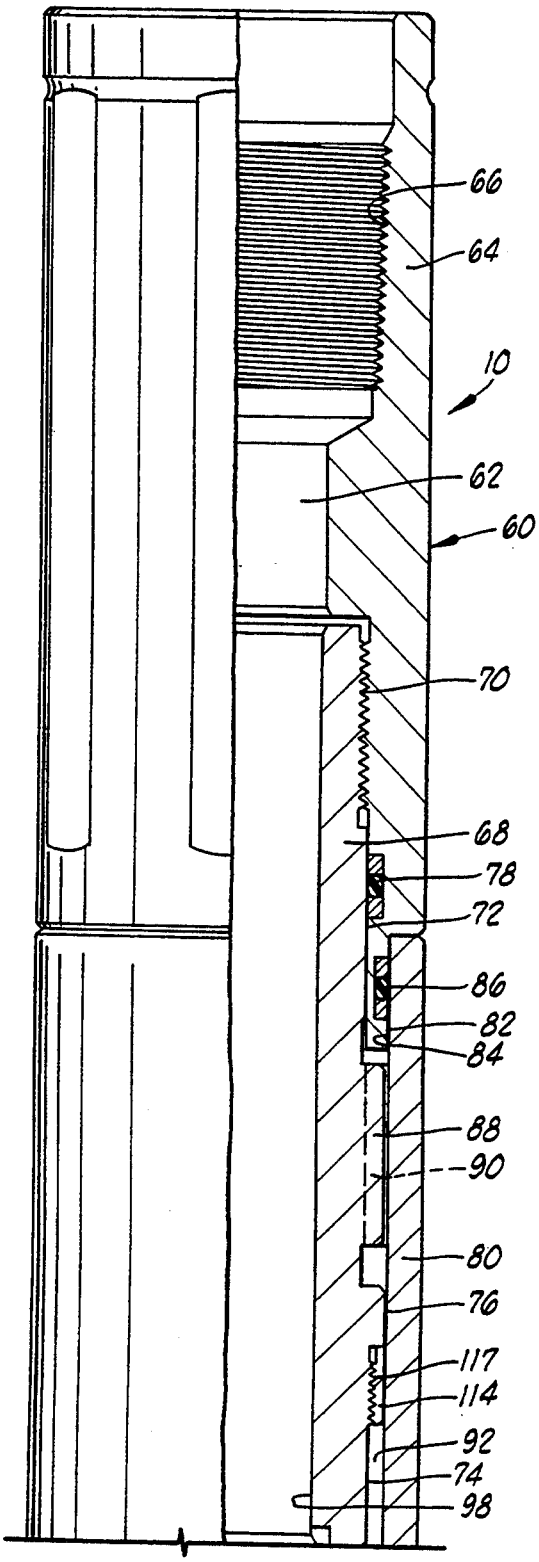
FIGS. 2A–2D show a partial elevation and sectional view of the pressure test and bypass valve.
Figure 2B:
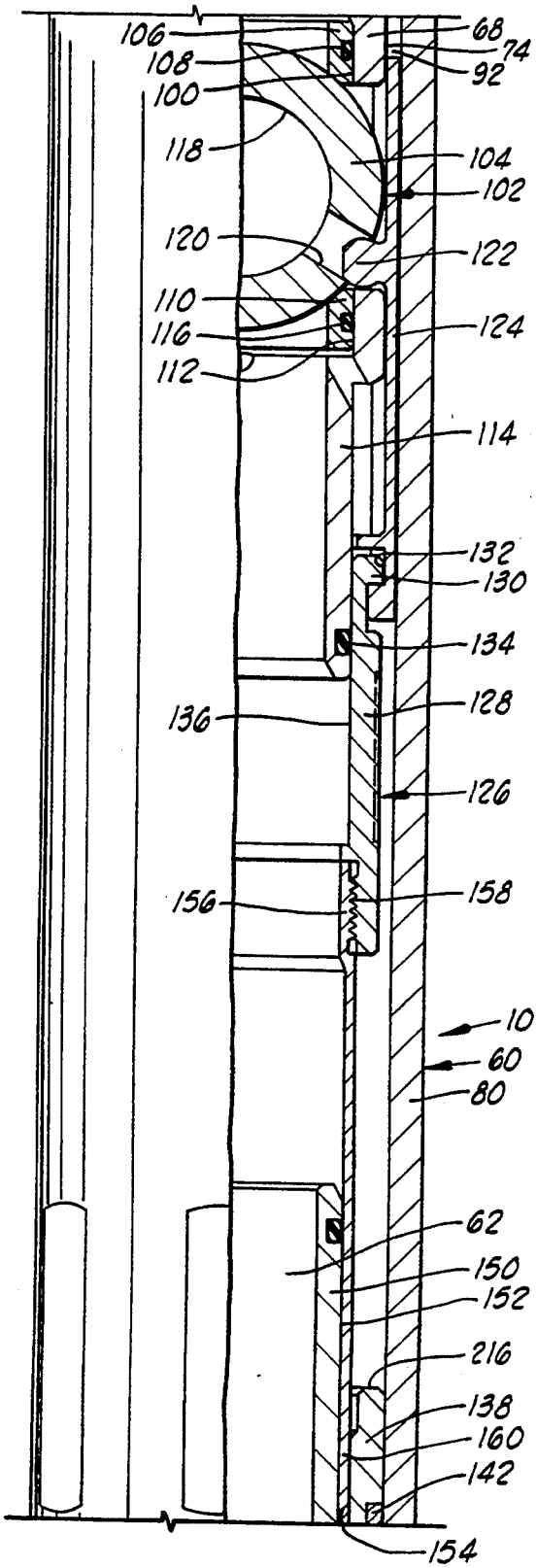

Upper seat carrier 68 defines a first bore 98 therein, as seen in FIG. 2A, and a slightly larger second bore 100, as seen in FIG. 2B.

Still referring to FIG. 2B, a first or upper valve means 102 is disposed within valve case 80 adjacent to the lower portion of upper seat carrier 68. In the preferred embodiment, first valve means 102 is characterized by a ball valve assembly 102 of a kind generally known in the art.

Ball valve assembly 102 includes a spherical valve member 104 which is disposed across central opening 62 of housing means 60. An upper seat 106 is seated against valve member 104 and disposed in second bore 100 of upper seat carrier 68. A sealing means, such as O-ring 108, provides sealing engagement between upper seat 106 and upper seat carrier 68.

Below valve member 104 is a lower seat 110 which is seated against the valve member. Lower seat 110 is disposed in bore 112 of a lower seat carrier 114. A sealing means, such as O-ring 116, provides sealing engagement between lower seat 110 and lower seat carrier 114.

Upper seat carrier 68 and lower seat carrier 114 are connected together by threaded connection 117 above ball valve assembly 102 (See FIG. 2A).

Valve element 104 defines a valve bore 118 therethrough and has an eccentric hole 120. A lug 122 extends into hole 120 from a lug carrying mandrel 124. The upper portion of lug carrying mandrel 124 extends into annular volume 92 defined between upper seat carrier 68 and valve case 80, and the lower end of the lug carrying mandrel is disposed generally around lower seat adapter 114 within valve case 80. Lug carrying mandrel 124 is slidably disposed within valve case 80.

A mandrel means 126 for sliding in central opening 62 of housing means 60 extends downwardly from lug carrying mandrel 124. The upper portion of mandrel means 126 comprises a valve mandrel 128 having a radially outwardly extending shoulder portion 130 engaged with an internal groove 132 defined in the lower portion of lug carrying mandrel 124 so that mandrel means 126 and lug carrying mandrel 124 move together. Thus, lug carrying mandrel 124 may be said to form a portion of mandrel means 126.

A sealing means, such as O-ring 134, provides sealing engagement between lower seat carrier 114 and bore 136 in valve mandrel 128.

Figure 2C:
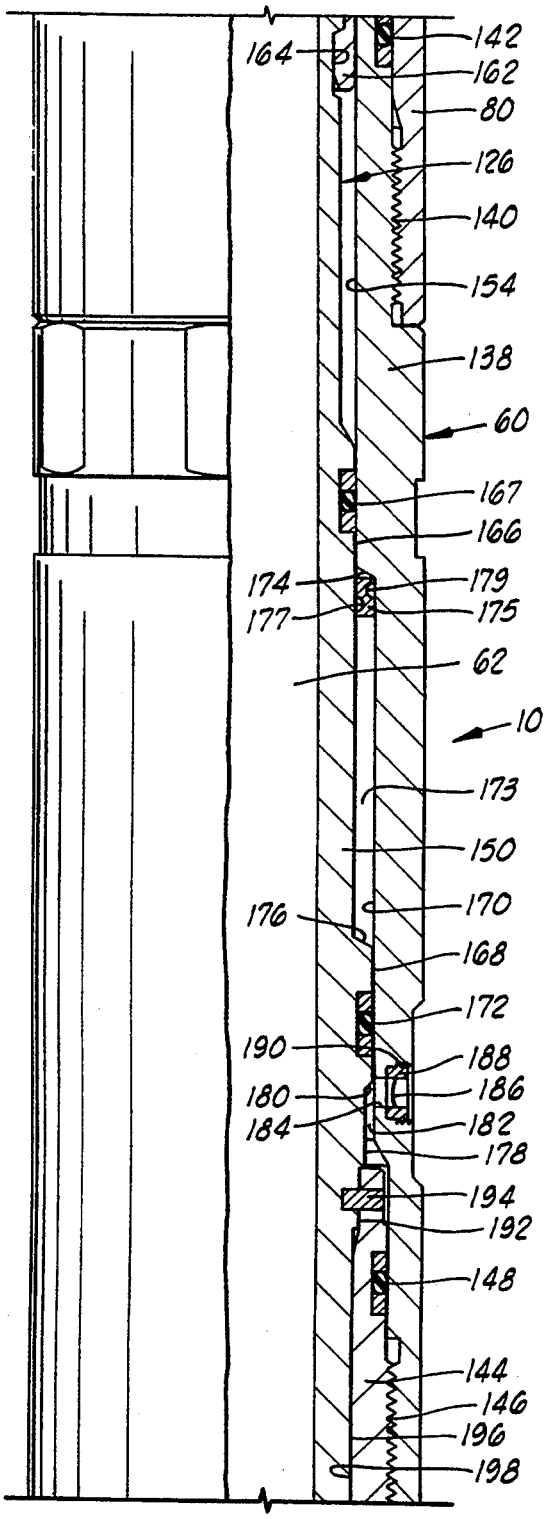

Referring now to FIG. 2C, the lower end of valve case 80 is connected to a rupture disc housing 138 at threaded connection 140. A sealing means, such as seal 142, provides sealing engagement between valve case 80 and rupture disc housing 138. It will be seen that rupture disc housing 138 forms a portion of housing means 60.

The lower end of rupture disc housing 138 is connected to a second or lower valve case 144, also referred to as bypass valve case 144, at threaded connection 146. A sealing means, such as seal 148, provides sealing engagement between rupture disc housing 138 and bypass valve case 144. It will be seen that bypass valve case 144 also forms a portion of housing means 60.

Figure 2D:
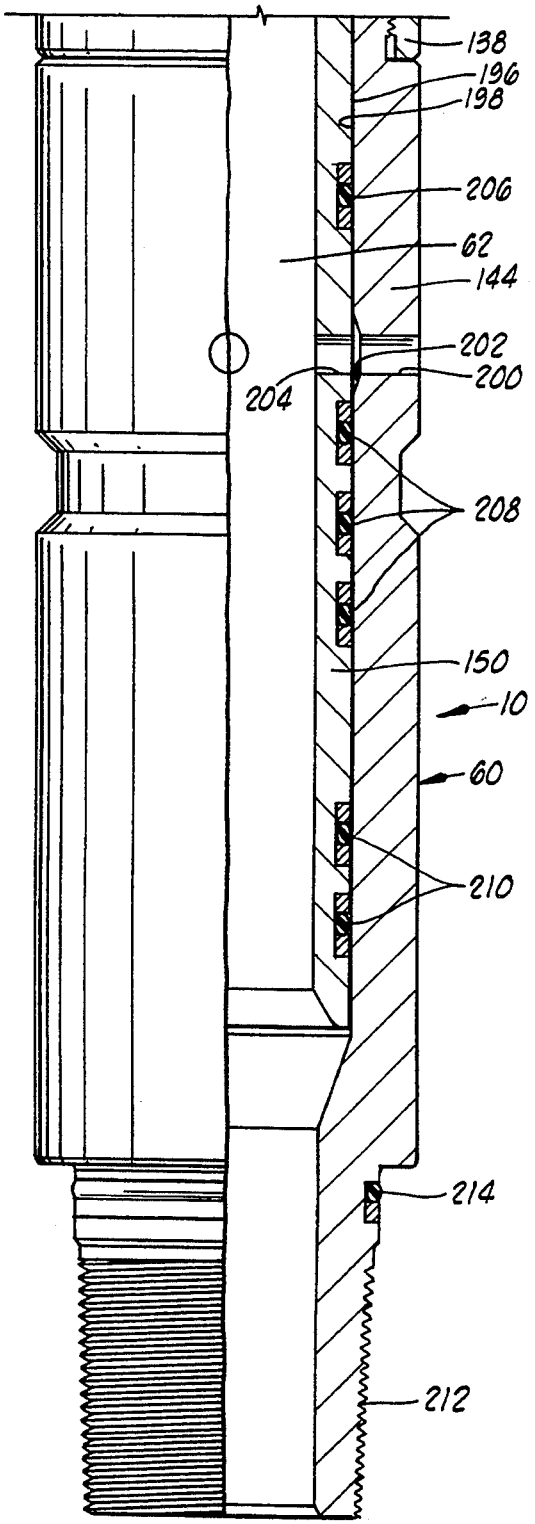

As seen in FIGS. 2B–2D, a second, lower valve means 150 is slidably disposed in rupture disc housing 138 and bypass valve case 144. Valve means 150 may be characterized by a valve sleeve 150 which has a first outside diameter 152 spaced radially inwardly from a first bore 154 in rupture disc housing 138.

Referring now to FIGS. 2B and 2C, the lower end of valve mandrel 128 is attached to a spring ring 156 at threaded connection 158. Spring ring 156 has a plurality of downwardly extending spring fingers 160 which are disposed between first outside diameter 152 of valve sleeve 150 and first bore 154 in rupture disc housing 138. Each finger 160 has a lug 162 at the lower end thereof which is engaged with a groove 164 when the apparatus is in the position shown in FIGS. 2A–2D. It will be seen by those skilled in the art that in this position, spring ring 156 is initially locked with respect to valve sleeve 150 and slidable therewith. Thus, valve sleeve 150 and spring ring 156 may be said to be part of mandrel means 126.

Referring now to FIG. 2C, valve sleeve 150 has a second outside diameter 166 adapted for close sliding engagement with first bore 154 in rupture disc housing 138. A sealing means, such as seal 167, provides sealing engagement between valve sleeve 150 and first bore 154.

Valve sleeve 150 has a third outside diameter 168 which is in close sliding engagement with second bore 170 of rupture disc housing 138. A sealing means, such as seal 172, provides sealing engagement between third outside diameter 168 of valve sleeve 150 and second bore 170 of rupture disc housing 138.

Second outside diameter of valve sleeve 150 is spaced inwardly from the second bore 170 in valve case 138 so that a chamber 173 is defined therebetween. Chamber 173 is sealingly closed at its upper end by seal 167 and at its lower end by seal 172. In the preferred embodiment, chamber 173 is filled with low pressure air, and thus may be referred to as an air chamber 173.

A cushioning means, such as an annular bumper or cushion 175, is disposed in air chamber 173. Defined in bumper 175 are longitudinally staggered inner and outer grooves 177 and 179. Grooves 177 and 179 allow bumper 175 to partially collapse when longitudinal force is applied thereto, as will be further described herein.

A housing shoulder 174 is formed in rupture disc housing 138 between first bore 154 and second bore 170 thereof. A corresponding sleeve shoulder 176 is formed on valve sleeve 150 between second outside diameter 166 and third outside diameter 168 thereof. It will be seen that bumper 175 is disposed between shoulders 174 and 176.

Valve sleeve 150 has a fourth outside diameter 178 thereon, and a downwardly facing shoulder 180 is thus formed on valve sleeve 150 between third outside diameter 168 and fourth outside diameter 178.

Fourth outside diameter 178 of valve sleeve 150 is spaced inwardly from second bore 170 of rupture disc housing 138 such that an annular volume 182 is defined therebetween below shoulder 180. A port 184 is defined transversely through rupture disc housing 138 and is in communication with annular volume 184. A pressure responsive means, such as a rupture disc 186, is disposed across port 184 and held in place by a rupture disc retainer 188 which is attached to rupture disc housing 138 at threaded connection 190. It will be seen that port 184 is disposed below seal 172.

Below port 184, valve sleeve 150 defines a fifth outside diameter 192 which is smaller than fourth outside diameter 178. A shearing means, such as a shear pin 194, initially locks valve sleeve 150 with respect to valve case 144 adjacent to fifth outside diameter 192 of the valve sleeve.

Below fifth outside diameter 192, valve sleeve 150 has a smaller sixth outside diameter 196 which is adapted for close, sliding engagement within a bore 198 in valve case 144.

Referring now to FIG. 2D, bypass valve case 144 defines at least one transverse case bypass port 200 therethrough which is in communication with an annular recess 202 formed in bore 198. Valve sleeve 150 defines at least one transverse valve bypass port therethrough, corresponding to port 200 in valve case 144. Valve bypass port 204 provides communication between central opening 62 and annular recess 202. It will be seen by those skilled in the art that valve bypass port 204 and case bypass port 200 are always in fluid communication as a result of the presence of recess 202. Thus, as shown in FIG. 2D, bypass valve means 150 of apparatus 10 is in an open position.

Above valve bypass port 204 and case bypass port 200 a first sealing means, such as upper seal 206, provide sealing engagement between valve sleeve 150 and valve case 144. Below valve bypass port 204, a second sealing means, such as a plurality of intermediate seals 208, provide sealing engagement between valve sleeve 150 and valve case 144. In the initial, open position shown in FIG. 2D, intermediate seals 208 are below case bypass port 200.

Below the second sealing means is a third sealing means, such as a plurality of lower seals 210, which provide sealing engagement between valve sleeve 150 and valve case 144 below valve bypass port 204 and case bypass port 200.

The lower end of valve case 144 has an externally threaded surface 212 adapted for engagement with a lower portion of testing string 12. Thus, valve case 144 may also be referred to as a lower adapter 144 of valve apparatus 10. A sealing means, such as seal 214 may be provided for sealing engagement between valve case 144 and the corresponding component of the lower portion of testing string 12.

OPERATION OF THE INVENTION

Valve apparatus 10 is made up as a portion of testing string 12 in the position shown in FIGS. 2A–2D and is lowered into the well bore 18 in the initial position shown in which bypass valve means 150 is open. First valve means 102 is closed.

Open bypass ports 200 and 204 provide a means for bypassing the fluid required to sting in and out of production packer 48. It is not necessary that the well be perforated prior to running valve apparatus 10 into the well bore.

When first valve means 102 is closed, the portion of testing string 12 above valve apparatus 10 may be pressure tested to check for leaks in the testing string. Preferably, first valve means 102 will allow the upper portion of testing string 12 to be pressure tested to about 15,000 psi differential pressure across valve member 104.

Once testing string 12 is spaced out in well bore 18, a test may be carried out. Pressure is applied in well annulus 46, and once this pressure reaches a predetermined level, rupture disc 186 will rupture thereby communicating well annulus fluid pressure into annular volume 182 in valve apparatus 10 (see FIG. 2C). This pressure will act upwardly on shoulder 180 on valve sleeve 150 which will cause sufficient upward force on the valve sleeve to shear shear pin 194. Valve sleeve 150 will slide or move upwardly such that intermediate seals 208 are moved above case bypass port 200, thereby sealingly separating case bypass port 200 and valve 204 so that bypass valve means 150 is closed.

The pressure acting on valve sleeve 150 will cause it to move rapidly. Upward sliding movement is limited when shoulder 176 on valve sleeve 150 contacts bumper 175. Bumper 175 is crushed between shoulder 176 on valve sleeve 150 and shoulder 174 in rupture disc housing 138. The collapse of bumper 175 cushions the blow and prevents damage which would be caused by the direct impact of shoulder 176 with shoulder 174. In this way, valve apparatus 10 may be later removed from the well bore and disassembled and retrimmed for later use. It is a simple matter to replace bumper 175; the more expensive, complex components, namely valve sleeve 150 and rupture disc housing 138, remain undamaged.

The upward sliding movement of valve sleeve 150 will move spring ring 156, valve mandrel 128, and lug carrying mandrel 124 upwardly with respect to housing means 60. It will be seen by those skilled in the art that this upward movement of valve carrying mandrel 124 will cause valve mandrel 104 in first valve means 102 to be rotated to its open position due to the engagement of lug 122 with hole 120 in valve member 104. That is, valve bore 118 in valve member 104 will be aligned with central opening 62, thus allowing fluid flow through the central opening.

The downward sliding movement necessary to close bypass valve means 150 is greater than that required to close first valve means 102. A means for compensating for this difference is provided by the engagement of spring fingers 160 with the upper end of valve sleeve 150. That is, during initial movement of valve sleeve 150, spring fingers 160 and spring ring 156 move upwardly with the valve sleeve. As soon as lugs 162 on the lower end of spring fingers 162 pass upwardly by upper end 216 of rupture disc housing 138, they are no longer held in engagement with valve sleeve 150. When first valve means 102 is moved to its open position, movement of lug carrying mandrel 124, valve mandrel 128 and spring ring 156 is stopped. Further upward movement of valve sleeve 150 causes recess 164 to be forced upwardly past lugs 162 on spring fingers 160, thus disengaging the valve sleeve from the spring fingers. Further upward movement of valve sleeve 150 results in no additional upward movement of spring fingers 160 on spring ring 156. Thus, there is no danger of damaging the components of first valve means 102 by applying too much force thereto from valve sleeve 150. That is, a means is provided for preventing overactuation of first valve means 102. Stated in another way, a means is provided for allowing different longitudinal movement to close bypass valve means 150 and open first valve means 102.

Prior to actuation, valve apparatus 10 may be stung into and out of production packer 48 as many times as desired without prematurely opening first valve means 102. That is, first valve means 102 cannot be opened accidentally and requires well annulus pressure to rupture rupture disc 186 and actuate the valve.

It will be seen, therefore, that the pressure test and bypass valve with rupture disc of the present invention is well adapted to carry out the ends and advantages mentioned, as well as those inherent therein. While a presently preferred embodiment of the apparatus is shown for the purposes of this disclosure, numerous changes in the arrangement and construction of parts may be made by those skilled in the art. All such changes are encompassed within the scope and spirit of the appended claims.

What is claimed is:

1. An apparatus for use in a well bore comprising:

housing means for defining a central opening therein and a port therein in communication with said central opening;

mandrel means for close sliding engagement in said central opening;

first valve means for allowing fluid flow through said central opening when in an open position and for preventing fluid flow through said central opening when in a closed position;

second valve means for allowing communication between said central opening and a well annulus when in an open position and preventing communication between said central opening and the well annulus when in a closed position; and pressure responsive means for sliding said mandrel means and thereby substantially simultaneously actuating said first and second valve means between said open and closed positions thereof in response to a pressure in said well annulus.

2. The apparatus of claim 1 wherein said first valve means is characterized by a ball valve connected to said mandrel means.

3. The apparatus of claim 1 wherein said first valve means is in said closed position thereof prior to an initial actuation of said first valve means.

4. The apparatus of claim 1 wherein said second valve means is characterized by a valve sleeve connected to said mandrel means and defining a port therethrough in communication with said port in said housing means when said second valve means is in said open position thereof.

5. The apparatus of claim 4 further comprising cushioning means for cushioning movement of said valve sleeve after actuation of said second valve means.

6. The apparatus of claim 1 wherein said second valve means is in said open position thereof prior to an initial actuation of said second valve means.

7. The apparatus of claim 1 further comprising shearing means for shearably holding said mandrel means with respect to said housing means and for shearing in response to said annulus pressure being applied to said mandrel means after application of said annulus pressure to said pressure responsive means.

8. The apparatus of claim 1 further comprising means for compensating for different longitudinal movement of components of said first and second valve means after actuation of said first and second valve means by said pressure responsive means.

9. An apparatus for use in a wellbore comprising:

housing means for defining a central opening therein and a port therein in communication with said central opening;

mandrel means for close sliding engagement in said central opening;

first valve means for allowing fluid flow through said central opening when in an open position and for preventing fluid flow through said central opening when in a closed position;

second valve means for allowing communication between said central opening and a well annulus when in an open position and preventing communication between said central opening and the well annulus when in a closed position; and pressure responsive means for substantially simultaneously actuating said first and second valve means between said open and closed positions thereof in response to a pressure in said well annulus, said pressure responsive means being characterized by a rupture disc which is adapted for rupturing in response to a differential pressure thereacross and thereby allowing said annulus pressure to act across an area on said mandrel means such that said mandrel means is moved relative to said housing means.

10. A valve apparatus for use in a tool string in a well bore, said apparatus comprising:

an outer housing defining a central opening therein and a transverse port in communication with said central opening;

a ball valve assembly disposed in said housing and having a closed position preventing fluid flow through said central opening and an open position allowing fluid flow through said central opening;

a mandrel disposed in close slidable engagement in said housing and operatively engaged with said ball valve assembly such that movement of said mandrel will actuate said ball valve assembly between said open and closed positions thereof;

a valve sleeve slidably disposed in said housing and connected to said mandrel for mutual sliding movement therewith in said housing, said valve sleeve defining a port therethrough in communication with said port in said housing when in an open position and sealingly separated from said port in said housing when in a closed position; and pressure responsive means for acting on said valve sleeve for moving the valve sleeve between said open and closed positions thereof and thereby actuating said mandrel and said ball valve assembly in response to a pressure in a well annulus.

11. The apparatus of claim 10 wherein said ball valve assembly is in said closed position thereof prior to an initial actuation of said ball valve assembly.

12. The apparatus of claim 10 wherein said valve sleeve is in said open position thereof prior to an initial actuation of said valve sleeve.

13. The apparatus of claim 10 wherein said pressure responsive means comprises:

a shoulder defined on said valve sleeve;

a rupture disc port defined through said housing adjacent to said shoulder; and a rupture disc disposed across said rupture disc port and adapted for rupturing in response to a differential pressure thereacross as a result of well annulus pressure such that said well annulus pressure acts on said shoulder for moving said valve sleeve with respect to said housing.

14. The apparatus of claim 10 comprising a shear pin for shearably holding said valve sleeve with respect to said housing and for shearing as said valve sleeve is moved with respect to said housing.

15. The apparatus of claim 10 further comprising first sealing means for sealing between said valve sleeve and said housing above said port in said housing;

second sealing means for sealing between said valve sleeve and said housing below said port in said housing when said valve sleeve is in an open position and for sealing between said valve sleeve and said housing above said port in said housing when said valve sleeve is in a closed position; and third sealing means for sealing between said valve sleeve and said housing below said port in said housing.

16. The apparatus of claim 10 wherein:

said housing and said valve sleeve define an air chamber therebetween;

said housing comprises a housing shoulder thereon;

said valve sleeve defines a sleeve shoulder thereon generally facing said housing shoulder; and said apparatus further comprises cushioning means disposed in said air chamber between said shoulders for limiting movement between said valve sleeve and said housing and preventing direct contact of said sleeve shoulder with said housing shoulder.

17. The apparatus of claim 16 wherein said cushioning means is characterized by an annular bumper defining inner and outer grooves therein.

18. The apparatus of claim 17 wherein said inner and outer grooves are longitudinally staggered.

19. The apparatus of claim 10 further comprising means for compensating for different longitudinal movement of said valve sleeve and said mandrel.

20. The apparatus of claim 19 wherein said means for compensating is characterized by:

said valve sleeve defining a groove therein; and said mandrel comprising a spring finger extending therefrom, said spring finger having a lug thereon engaged with said groove and held into such engagement by a portion of said housing;

wherein, said mandrel moves with said valve sleeve until said lug is moved past said portion of said housing such that further movement of said valve sleeve causes disengagement of said spring finger from said groove, thereby preventing further movement of said mandrel with said valve sleeve.

* * * * *